United States Patent [19]

Nagano

[11] 4,240,868

[45] Dec. 23, 1980

[54] LABEL FEEDING APPARATUS

[75] Inventor: Yasuaki Nagano, Kanazawa, Japan

[73] Assignee: Shibuya Kogyo Co., Ltd., Ishikawa, Japan

[21] Appl. No.: 43,721

[22] Filed: May 30, 1979

[51] Int. Cl.[3] ..... B65C 9/08

[52] U.S. Cl. ..... 156/572

[58] Field of Search ..... 156/570–572

[56] References Cited

U.S. PATENT DOCUMENTS

| | | | |
|---|---|---|---|
| 1,901,101 | 3/1933 | Holm | 156/570 |
| 3,129,130 | 4/1964 | Lerner | 156/572 |

FOREIGN PATENT DOCUMENTS

| | | | |
|---|---|---|---|
| 2256552 | 11/1972 | Fed. Rep. of Germany | 156/570 |

*Primary Examiner*—Douglas J. Drummond

*Attorney, Agent, or Firm*—Fidelman, Wolffe & Waldron

[57] ABSTRACT

A label feeding apparatus for removing labels with the use of suction one by one from a label magazine in which a quantity of labels are stored and sending it to a label sticking device where labels are stuck to containers such as bottles and cans. The label feeding apparatus comprises a pivotally supported guide lever on which a slide member is slidably mounted. The slide member is provided with a label holding mechanism including suction members. The cooperation between the pivotal motion of the guide lever and the reciprocating motion of the slide member defines a particular closed path of the movement of the label holding mechanism. During one cycle of this closed path, one label is removed from the label magazine and fed to the label sticking device.

6 Claims, 4 Drawing Figures

LABEL FEEDING APPARATUS

BACKGROUND OF THE INVENTION

The present invention relates to a label feeding apparatus for supplying labels one by one to a label sticking device where labels are stuck to containers such as bottles and cans, and more in particular, it is concerned with an apparatus which is capable of supplying labels while keeping the label magazine stationary.

Conventionally in order to stick labels to containers such as bottles and cans which are transported by riding on a belt conveyor, a glued label is held on a rotating application drum by suction with its glued surface facing outside and a container is pressed against the application drum for sticking the label to the container. For supplying labels to this application drum, a rotary type label feeding apparatus provided with a plurality of suction members is disposed between the application drum and the label magazine in which labels are removed one by one by means of these suction members and transferred to the application drum. In such a customary label feeding apparatus, the outer surface of the suction member must be arc-shaped since it is in a rotary contact with the application drum. For this reason, it is likely that a label is held only with line contact with the suction member. In view of this and in order to secure the label holding performance, the label magazine has to be moved back and forth and/or right and left in synchronism with the movement of the suction member. Thus, in a customary label feeding apparatus, the label magazine itself is necessarily complicated in structure; and moreover, the magazine cannot be replenished with labels while in operation. So, the label feeding operation must be temporarily stopped when the magazine is running out of labels, which constitutes one of the reasons for the low operation efficiency of the customary label feeding apparatuses.

SUMMARY OF THE INVENTION

In accordance with the present invention which has obviated the inconveniences of the prior art, suction means for holding a label by suction is temporarily held stationary while sucking the front end label through the exit of a label magazine so that a label can be securely held by the suction means. The present invention comprises a pivotally supported guide lever on which a slide member including the suction means is slidably mounted. As the guide lever executes its pivotal motion, the slide member is made to slide reciprocatingly along the guide lever. This associated motion between the guide lever and the slide member defines a particular path of the suction means, which allows use of a stationary level magazine. Therefore, the operation efficiency has been greatly improved because labels can be replenished at will. Moreover, the structure of a label feeding apparatus in accordance with the present invention has been extremely simplified so that it can be constructed more economically and it does not require any extensive care.

Other objects, features, and advantages of the present invention will become apparent after a reading of the remainder of this specification and the attached drawings.

DESCRIPTION OF THE PREFERRED EMBODIMENTS

Figure 1:
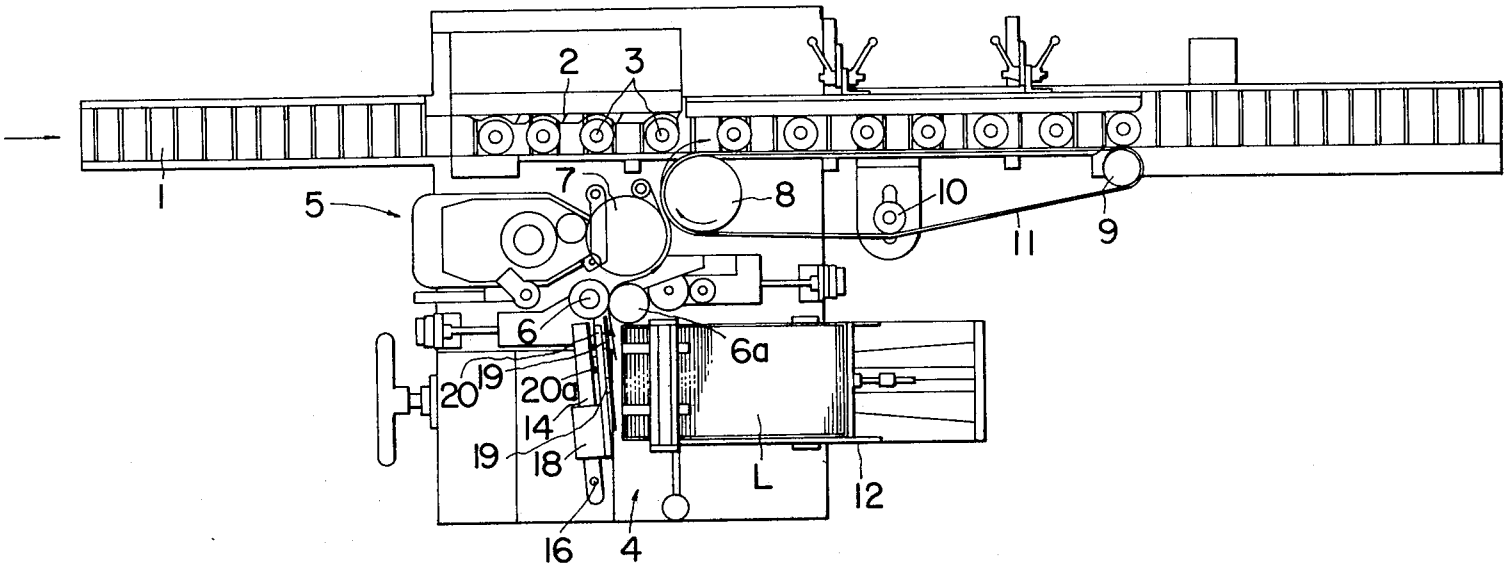
FIG. 1 is a plan view showing a label sticking system in which the present label feeding apparatus is incorporated.

Referring to FIG. 1, a label sticking system generally comprises a belt conveyor 1 which transports containers 3 carried thereon, a label feeding apparatus 4 and a label sticking device 5. First, a brief explanation will be had with respect to the operation of the label sticking system. The belt conveyor 1 transports the containers from left to right as shown with the arrow in FIG. 1. Then the containers 3 come into engagement with a timing screw 2, which regulates the spacing between the neighboring containers at a predetermined distance. On the other hand, the label feeding apparatus 4 comprises a label magazine 12 which stores labels L, and a pivotally supported lever 14 on which a slide member 18 is slidably mounted. The slide member 18 is provided with a support member 20 which comprises suction members 19. Due to the operation of the label supplying apparatus, labels L are removed one by one out of the label magazine 12 and fed to the label sticking device 5.

The label sticking device 5 comprises a pick-up roller 6, a counter roller **6*a* which is preferably pressed against the pick-up roller 6, a glue roller 7 and a suction roller 8. A perforated belt is extended between the suction roller 8 and an idle roller 9, and a tension roller is pressed against the belt 11 inbetween. Thus, when a label is fed to the label sticking device 5 by the label supplying apparatus 4, the leading edge of the label is led into the contact point between the pick-up roller 6 and the counter roller 6*a*. Then the label is brought into contact with the glue roller 7 to apply glue on one side surface thereof. The glued label is then transferred onto the suction roller 8 with the glued surface facing outside to be finally stuck onto a container 3. The feeding path of a label is indicated with the arrow in FIG. 1**.

Figure 2:
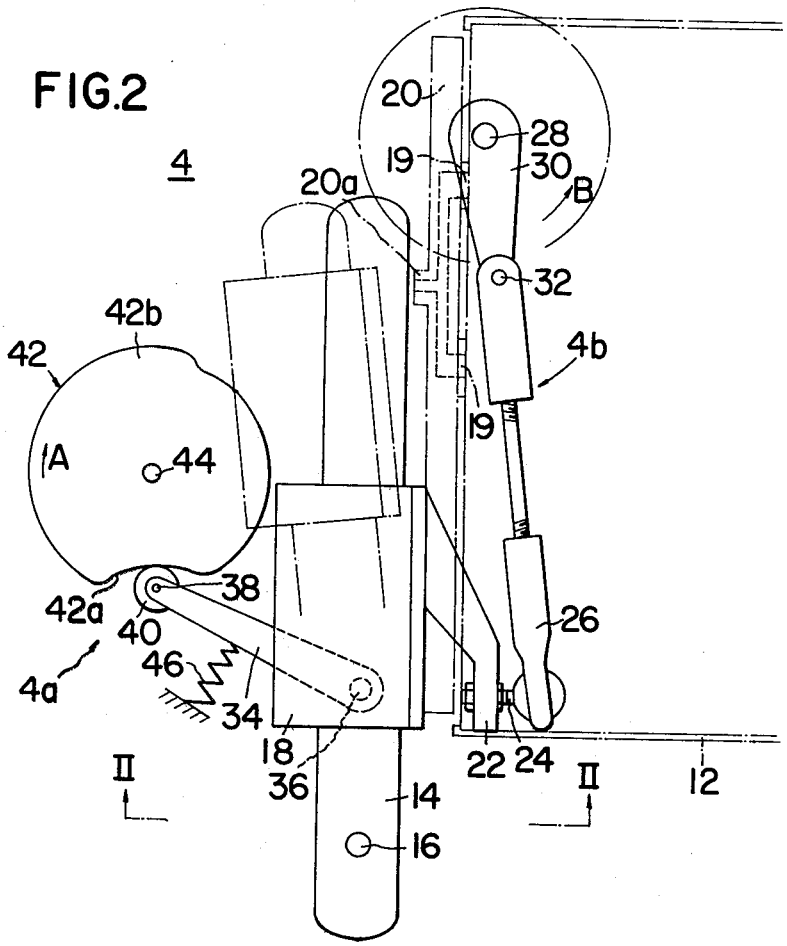
FIG. 2 is a plan view showing in more detail the present label feeding apparatus.
Figure 3:
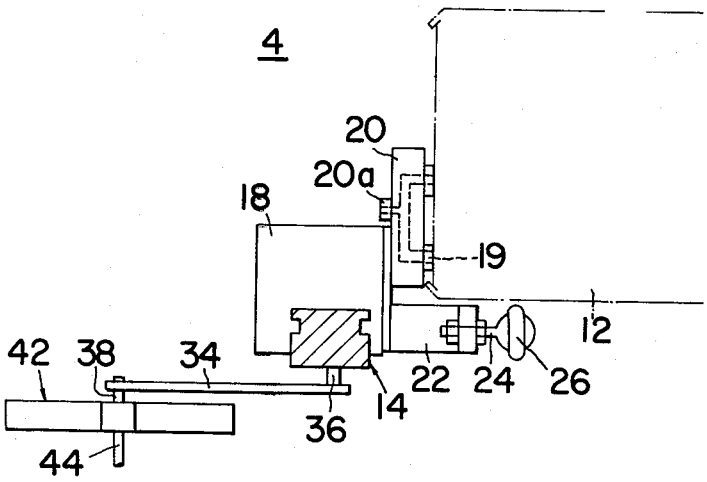
FIG. 3 is a particularly sectional front view of the apparatus shown in FIG. 2.

Referring now to FIGS. 2 and 3, the label feeding apparatus 4 comprises the pivotally supported guide lever 14, the slide member 18 slidably mounted on the guide lever 14 and fixedly provided with the support member 20 having the suction members 19 thereon, a pivotal motion control mechanism **4*a* operatively connected to the guide lever 14, a sliding motion control mechanism 4*b* operatively connected to the slide member 18, and the label magazine 12** which stores labels L.

As shown in FIG. 2, the guide lever 14 is pivotally supported by a pin 16 which is planted in a machine housing. The support member 20 is integrally provided on the slide member 18 and it can be brought to the position opposite to the front end label located at the exit of the label magazine 12 with a small gap therebetween. The support member 20 is provided with a plurality of suction members 19, and they are fluiddynamically connected to a port **20*a* which, in turn, can be connected to a vacuum source (not shown). Therefore, when the support member 20 is positioned opposite to the front end label located at the exit of the label magazine 12, the suction members 19 are connected to the vacuum source to have the front end label in the label magazine 12 securely held by the suction members 19. Then the label thus held by the suction members 19 is delivered to the pick-up roller 6. When the leading edge of the label is pinched between the pick-up roller 6 and the counter roller 6***a* , the connection between the suction members 19 and the vacuum source is disconnected to release the label.

The slide member 18 is further provided with a projecting arm 22, which supports a pivot element 24 at its forward end. The pivot element 24 is pivotally connected to one end of a connecting rod 26, the other end of which is connected to a pin 32 of a crank arm 30 fixed to a driving shaft 28.

While, a lever 34 has its one end, which is fixed to the guide lever 14 by means of a pin 36 at an appropriate position, and the other end which supports a roller 40 rotatably by means of a pin 38. A cam 42 is fixed to a driving shaft 44, and the roller 40 is resiliently pressed against the peripheral surface of the cam 42 by way of a spring 46. The cam 42 is provided with a raised portion 42*b* and a dent 42*a*. The driving shaft 44 rotates in synchronism with the shaft 28 in the direction indicated by the arrow.

When the crank arm 30 takes the position as shown in FIG. 2, the slide member 18 is at a retracted position which is closest to the pin 16 along the guide lever 14. In this situation, since the roller 40 is located at the midpoint of the dent 42*a* formed on the cam 42, the guide lever 14 is in parallel with the exit of the label magazine 12 as shown with the solid line in FIG. 2. On the other hand, the suction members 19 provided on the support member 20 are in close contact with the front end label. It should, however, be noted that, if the suction is strong enough, it is also possible that the suction members 20 are spaced apart from the front end label.

As the cam 42 and the crank arm 30 rotate in synchronism in the direction indicated by the arrow, the roller 40 shifts its position by following the dent 42*a* formed on the cam 42; which, in turn, causes the guide lever 14 to turn counterclockwise through the lever 34 against the force of the spring 46. At the same time, the crank arm 30 moves the connecting rod 26; however, since the counterclockwise pivotal motion of the guide lever 14 brings the forward end of the projecting arm 22 closer to the driving shaft 28, the movement of the connecting rod 26 is compensated, and therefore the slide member 18 keeps its relative position unchanged with respect to the guide lever 14 for a short period of time, which constitutes a quasi-stationary state. Thereafter, further rotation of the crank arm 30 starts to move the slide member 18 along the guide lever 14. On the other hand, a similar quasi-stationary state occurs when the roller 40 comes into the dent 42*a*. As a result, although the crank arm 30 continues its rotation without interruption, the slide member 18 temporarily stays still at its retracted position on the guide lever 14 and this allows for the suction members 19 to securely hold the front end label.

When the roller 40 moves out of the dent 42*a*, the slide member 18 holding a label on the suction members 19 advances along the guide lever 14 in association with the rotation of the crank arm 30. The slide member 18 finally reaches the advanced position where the leading edge of the label held on the suction members 19 is pinched between the pick-up roller 6 and the counter roller 6*a*. So, by disconnecting the suction members 19 from the vacuun source (not shown), the label is released and fed to the label sticking device 5.

Figure 4:
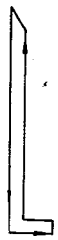
FIG. 4 is a schematic illustration showing the moving path of the suction member.

When the crank arm 30 comes to the position 180 degrees rotated from the position shown in FIG. 2, the cam 42 is also rotated by 180° and the roller 40 comes into engagement with the raised portion 42*b*. Because of this, the guide lever 14 makes a further counterclockwise movement and then the slide member 18 starts its returning motion toward the retracted position. Then, when the roller 40 comes into the dent 42*a*, the guide lever 14 pivots clockwise and the slide member 18 enjoys the quasi-stationary state; whereas, the suction members 19 are brought into contact with the next label located at the front end of the label magazine 12. The moving path of the slide member 18 is schematically shown in FIG. 4.

In the specific embodiment of the present invention described above, use is made of a cam as means for controlling the pivotal motion of the guide lever; however, it goes without saying that any alternative elements having the same function and effect can be applied. Furthermore, suction members can be replaced with sticky members such as adhesive tape.

It will be understood that various changes in details, materials and arrangement of parts, which have been herein described and illustrated in order to explain the nature of the invention, may be made of those skilled in the art within the principle and scope of the invention as expressed in the appended claims. However, while the invention has been described with reference to the structure disclosed herein, it is not to be confined to the details set forth, and this application is intended to cover such modifications or changes as may come within the scope of the following claims.

I claim:

1. An apparatus for feeding labels one by one to a label sticking device which sticks labels on containers, comprising:

a label magazine storing a quantity of labels;

a guide lever pivotally supported in the vicinity of the exit of said label magazine;

a slide member slidably mounted on said guide lever;

holding means provided on said slide member for holding a label temporarily;

a first driving shaft;

a crank arm fixedly mounted on said first driving shaft;

means for connecting said slide member with said crank arm;

a second driving shaft which is driven in synchronism with said first driving shaft;

a cam fixedly provided on said second driving shaft; and a cam follower integrally provided with said guide lever and operatively connected to said cam.

2. An apparatus according to claim 1, wherein said holding means comprises a support member integrally mounted on said slide member and at least one suction member provided on said support member.

3. An apparatus according to claim 1, wherein said cam comprises a dent for keeping said slide member quasi-stationary at the retracted position of said guide lever, and a raised portion for the returning movement of said slide member to the retracted position.

4. An apparatus according to claim 3, wherein said cam follower comprises a roller resiliently pressed against the periphery of said cam.

5. A label sticking system including means for transporting containers such as bottles and cans separated at a predetermined distance one from another, label sticking means for sticking labels on said containers one by one, and label feeding means for feeding labels to said label sticking means, wherein said label feeding means comprises:

a label magazine storing a quantity of labels;

a guide lever pivotally supported in the vicinity of the exit of said label magazine;

a slide member slidably mounted on said guide lever;

holding means provided on said slide member for holding a label temporarily;

a first driving shaft;

a crank arm fixedly mounted on said first driving shaft;

means for connecting said slide member with said crank arm;

a second driving shaft which is driven in synchronism with said first driving shaft;

a cam fixedly provided on said second driving shaft; and a cam follower integrally provided with said guide lever and operatively connected to said cam.

6. A label sticking system according to claim 5, wherein said label sticking means comprises a pick-up roller, a counter roller which is pressed against said pick-up roller, a glue roller for applying glue on one side surface of a label, a suction roller for holding the thus glued label with its glued surface outside and sticking it to a container.

* * * * *